United States Patent [19]

Towns et al.

[11] Patent Number: 4,596,423

[45] Date of Patent: Jun. 24, 1986

[54] LEISURE CHAIR

[75] Inventors: Harold Towns, Alexander City; Hasel Holloway, Roanoke, both of Ala.

[73] Assignee: Craft House Corporation, Toledo, Ohio

[21] Appl. No.: 722,675

[22] Filed: Apr. 12, 1985

[51] Int. Cl.[4] ..... A47C 7/00

[52] U.S. Cl. ..... 297/440; 297/443

[58] Field of Search ..... 297/440, 441, 442, 443, 297/444; 248/188.1

[56] References Cited

U.S. PATENT DOCUMENTS 3,915,493 10/1975 Brown ..... 297/440

4,079,994 3/1978 Kehl ..... 297/440

4,119,286 10/1978 Barril ..... 248/188.1

4,509,794 4/1985 Roland ..... 297/440

*Primary Examiner*—James T. McCall

*Attorney, Agent, or Firm*—Alfred L. Patmore, Jr.

[57] ABSTRACT

An all-weather leisure chair constructed in two pieces for disassembled transportation and storage and for assembled use. The seat-back component has a flange depending from its seat platform which receives the conforming seat support of the base frame component. The spring resiliency of the rod formed seat support acting against the seat flange maintains the integrity of the assembled structure without the use of separate fastening elements, resulting in an aesthetically pleasing unitary appearance.

9 Claims, 4 Drawing Figures

LEISURE CHAIR

This invention relates to chairs generally used in leisure environments such as a patio, porch, terrace or for general outdoor use, and, more particularly, to a two piece chair structure which can be assembled and disassembled for use and storage or transportation.

With furniture designed for casual use for exposure to general outdoor weather conditions, the structure is often made from round rod and metallic structures which produces a relatively light weight chair structure occupying a relatively large space volume, but of a small actual material volume. Transportation charges are generally high because they are based on the space occupied. Hence, there are a wide variety of chairs constructed of detachable parts which can be nested in the disassembled state facilitating packaging and storing, and saving considerable transportation cost. Most of these disassembled chairs require the use of fastening elements such as screws, pins, bolts, nuts and the like, which can be assembled with tools normally found in the home. This often produces a structure which loosens with use or has an unsightly appearance.

It is, therefore, a principal object of this invention to provide a two piece chair assembly which does not require the use of fastening elements for assembly, but which can be readily assembled and disassembled.

It is another object of this invention to provide a two piece chair assembly which can be used for an action chair without the problem of being disassembled or loosened during usage.

The foregoing objects of this invention are accomplished by providing a two piece chair including a seat-back structure and a base frame structure. The seat-back structure has a D-shaped seat platform with a flange depending around its periphery and an upstanding contoured back joined to the rear curved portion of the D-shaped platform by strut members. The straight portion opposite the rear curved portion of the D-shaped platform is the front of the chair. A pair of flat, spring loaded retaining tabs are located at the front of the seat platform adjacent to the ends of the straight portion and extending rearwardly from the lower end of the peripheral flange thus defining with the platform a pair of front recesses. A round rod retaining lug is located centrally on the rear curved portion of the seat platform extending forwardly from the lower end of the peripheral flange thus defining with the platform a rear recess. The base frame structure is constructed from round rod and has depending legs attached to an open D-shaped seat support member which conforms to the D-shaped inner periphery of seat platform flange. The opening in the D-shaped seat support member defines a gap in its rear curved portion between adjoining ends of the round rod forming it. The seat-back structure is assembled to the base frame structure by inserting the front straight rod of the seat support member into the front recesses of the seat-back assembly and by forcing the adjoining ends of the seat support rod member over the rod retaining lug and into the rear recess. The spring resiliency of the seat support member acting against the peripheral flange of the seat platform will keep the seat supported on the base even where the chair is an action chair, having coil springs in its base to permit rocking as in the illustrated embodiment of the invention.

The preferred embodiments of the invention are illustrated in the drawing in which.

Figure 1:
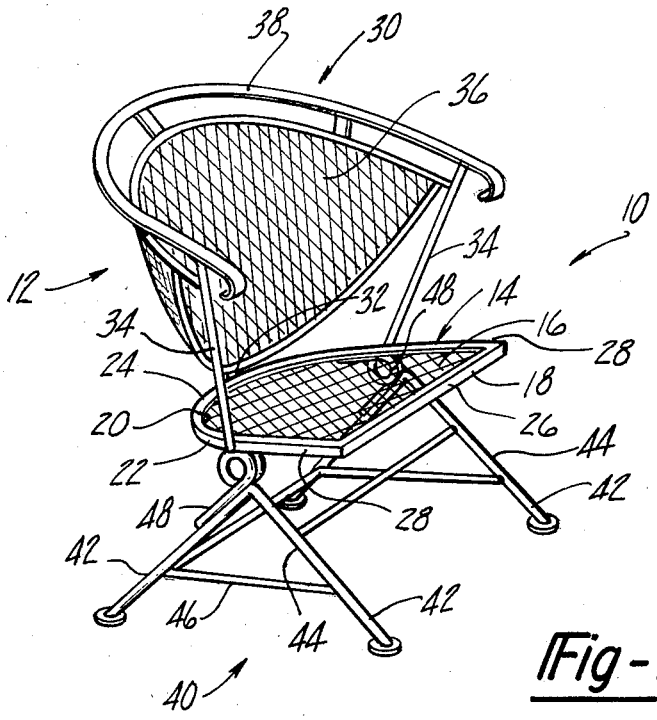
FIG. 1 is a perspective view of the assembled chair embodying the invention.

Referring to FIG. 1, the aesthetically pleasing appearance of chair assembly 10 with its stylized contoured back and action base makes it incredulous that it has the additional utility of a two piece structure which can be easily transported and stored in its disassembled state. The seat-back component or structure 12 has a D-shaped seat platform 14 with a mesh central portion 16 and a peripheral angle element 18 with horizontal flange portion 20 and depending flange portion 22. The curved portion 24 of peripheral angle 18 forms the rear of the D-shaped seat platform with the opposing straight portion 26 constituting the front of the chair. Generally straight side elements 28 complete the D-shaped peripheral angle 18. Back 30 is joined to the curved portion 24 of seat platform 14 by central strut 32 and side struts 34. Back 30 includes a contoured mesh body support portion 36 and a top circumposing arm rest 38.

The base frame component or structure 40 of the chair assembly 10 is formed from round bar or rod stock. Depending legs 42 are formed as a pair of vees 44 joined at their lower ends by rectangular frame member 46 and having at their upper ends coil springs 48 welded to open D-shaped seat support member 50 (see FIG. 2). When the seat-back component 12 is assembled to the base frame component 40, the seat support member 50 is completely hidden from normal view by depending flange 22 of peripheral angle element 18 as shown in FIG. 1.

Figure 2:
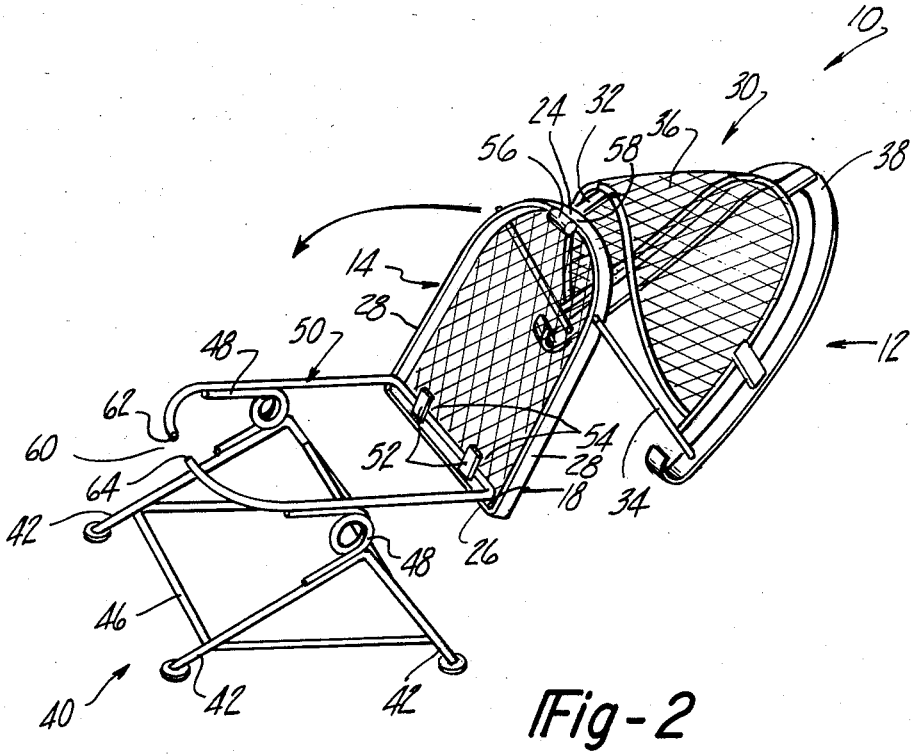
FIG. 2 is a perspective view similar to FIG. 1 showing the first step in assembling the seat-back structure to the base frame structure.

Referring to FIG. 2, a pair of spaced retaining tabs 52 are mounted on the straight front portion 26 of the peripheral angle 18 at the lower end of depending flange 22 extending rearwardly. Tabs 52 define with seat platform 14 a pair of front recesses 54. Preferrably tabs 52 are the substantially horizontal legs of L-shaped brackets subtending an angle less than 90° and made of a resilient steel. With the other leg of the bracket welded to depending flange 22, the tabs will act as spring clips. A round rod retaining lug 56 is located centrally on the rear curved portion 24 of D-shaped seat platform 18 extending forwardly from the lower edge of the depending flange portion 22 of peripheral angle element 18. Lug 56 defines with the seat platform 14 a rear recess 58. The open D-shaped seat support member 50 of base frame 40 conforms to the D-shaped inner periphery of seat platform depending flange 22. The opening in the D-shaped seat support member 50 defines a gap 60 in its rear curved portion between adjoining ends 62 and 64 of the round rod forming the seat support.

Figure 3:
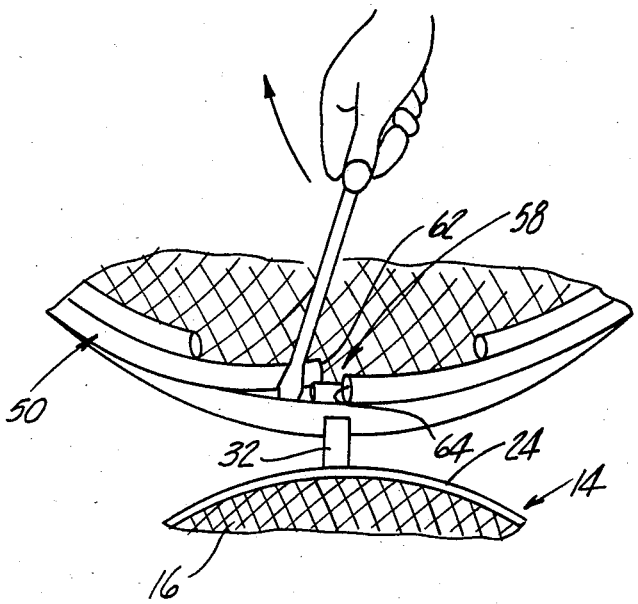
FIGS. 3 and 4 are enlarged fragmentary plan views from below showing the final two stages of assembly.
Figure 4:
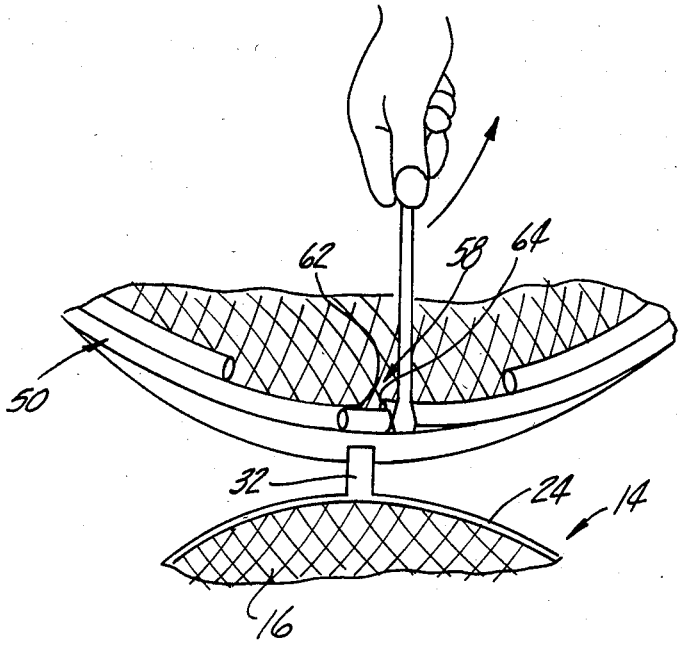

Referring to FIGS. 2–4, the steps for assemblying the seat-back structure 12 to the base structure 40 are shown in sequential order. With the base frame structure 40 on a level surface as shown in FIG. 2, the seat-back structure 12 can be lifted with the straight front 26 of the peripheral angle element 18 facing downward and the retaining tabs 52 pointed upward and inside the front straight edge of support member 50 to snap the support member between tabs 52 and flange 20 into front recesses 54. The seat-back structure 12 can then be pivoted counterclockwise so that seat platform 14 rests on the seat support 50 with the straight side portions of the D-shaped support within the peripheral angle element 18. The chair assembly can then be turned upside down so that the adjoining ends 62 and 64 of round rod seat support member can be snapped into place over round rod retaining lug 56 as shown in FIGS. 3 and 4. FIG. 3 shows end 62 being snapped over lug 56 into rear recess 58 between lug 56 and the seat platform 14, and FIG. 3 shows end 64 being snapped over lug 56 into rear recess 58 between lug 56 and the platform 14. As these ends are snapped into place they are brought closer together reducing the length of gap 60. The spring resiliency of the round rod seat support member 50 acting against the peripheral depending flange 22 of the seat platform 14 will keep the seat supported on the base. The assembly process can be reversed by first prying out ends 62 and 64 from rear recess 58 when it is desired to disassemble the chair to store it in a nested minimum space volume.

The embodiments of the invention in which an exclusive property or privilege is claimed are defined as follows:

1. A chair assembly comprising in combination: a seat-back structure having a seat platform with a depending peripheral flange; a pair of spaced retaining tabs located at the front of said seat platform extending rearwardly from the lower end of said flange; defining a pair of front recesses; a retaining lug located at the rear of said seat platform extending forwardly from the lower end of said flange forming a rear recess; and a base frame structure having depending legs and a seat support member conforming to the inner periphery of said flange, said support member having a gap in its rear between adjoining ends thereof, whereby said seat-back structure is assembled to said base frame structure by inserting the front side of said seat support member into said front recesses and forcing the adjoining ends of said support member over said retaining lug and into said rear recess.

2. The chair assembly of claim 1 wherein said seat platform is D-shaped with the straight portion opposite the curved portion of the D being located at the front, and said seat support member having a conformed D-shape.

3. The chair assembly of claim 2 wherein said spaced retaining tabs are located, one each, towards the ends of said straight portion and said retaining lug is located centrally on the rear curved portion of the D.

4. The chair assembly of claim 3 wherein said seat support member is formed into said D-shape from a round bar, and the gap at adjoining ends is less than the length of said retaining lug.

5. The chair assembly of claim 4 wherein said seat support member is formed from a round metal bar with resiliency to retain its formed shape.

6. The chair assembly of claim 5 wherein said D-shaped seat support member is formed slightly larger than the inner periphery of said seat platform flange in the rearward area whereby said gap is reduced as said seat support member is received within the peripheral flange of said seat platform and the adjoining ends of said support member are forced over said retaining lug into said back recess.

7. A chair assembly comprising, in combination: a seat-back structure having a D-shaped seat platform with a depending peripheral flange and an up-standing contoured back joined to the rear curved portion of said D-shaped platform by strut members, the straight portion opposite the rear curved portion of the D constituting the front of said chair; a pair of spaced retaining tabs located at the front of said seat platform adjacent the ends of said straight portion and extending rearwardly from the lower end of said flange defining with said platform a pair of front recesses; a retaining lug located centrally on said rear curved portion of said seat platform extending forwardly from the lower end of said flange and forming with said platform a rear recess; and a base frame structure formed of round rod and having depending legs and a seat support member conforming to the inner periphery of said flange, said support member having a gap in its rear curved portion between adjoining ends thereof, whereby said seat-back structure is assembled to said base frame structure by inserting the front side of said seat support member into said front recesses and forcing the adjoining ends of said support member over said retaining lug and into said rear recess.

8. The chair assembly of claim 7 wherein said retaining tabs are spring loaded toward said platform.

9. The chair assembly of claim 8 wherein said retaining lug is a round rod with its axis parallel to said seat platform.

* * * * *